United States Patent [19]

Witt et al.

[11] 4,259,892

[45] Apr. 7, 1981

[54] CARTRIDGE-HOLDER

[76] Inventors: Leonard Witt; Mary Witt, both of 1923 N. Howe St.-2R, Chicago, Ill. 60614

[21] Appl. No.: 8,097

[22] Filed: Jan. 31, 1979

[51] Int. Cl.[3] ..... F41F 17/08

[52] U.S. Cl. ..... 89/16

[58] Field of Search ..... 42/15, 76, 77; 89/16, 89/155, 156

[56] References Cited

U.S. PATENT DOCUMENTS

| | | | |
|---|---|---|---|
| 1,383,966 | 7/1921 | Oliver | 89/156 |
| 2,992,596 | 7/1961 | Hammer | 89/16 |
| 3,235,996 | 2/1966 | Maillard | 89/16 |

FOREIGN PATENT DOCUMENTS

| | | | |
|---|---|---|---|
| 13649 | of 1900 | United Kingdom | 89/156 |

*Primary Examiner*—Stephen C. Bentley

[57] ABSTRACT

In order to use cases for firearms of various materials such: aluminum, (which is inexpensive), brass, iron and to facilitate use of greater pressure while insuring reliable operation of the gun, this invention proposes the use of divided holders fixed in the chamber (dies which are adjustable). These holders, after discharge of the cartridge, move back along with the case and the bolt, a very short distance, spread out, loosening the case. The case moves farther along with the bolt, and is ejected in regular manner. The bolt introduces the next cartridge into the chamber, etc.

1 Claim, 4 Drawing Figures

CARTRIDGE-HOLDER

SUMMARY OF THE INVENTION

The reasons for the divided cartridge-holders being placed in the chambers of firearms, are:

(a) the possibilities of using various materials for cases with regard to the pressures: aluminum, brass (with both these pressure is about 55,000 lbs. psi$^{-1}$), and iron for higher pressures insuring the easy and reliable operation of the firearms, (b) the use of substitutes for brass lowers the weight and the cost of ammunition.

DETAILED DESCRIPTION OF THE INVENTION

Figure 1:
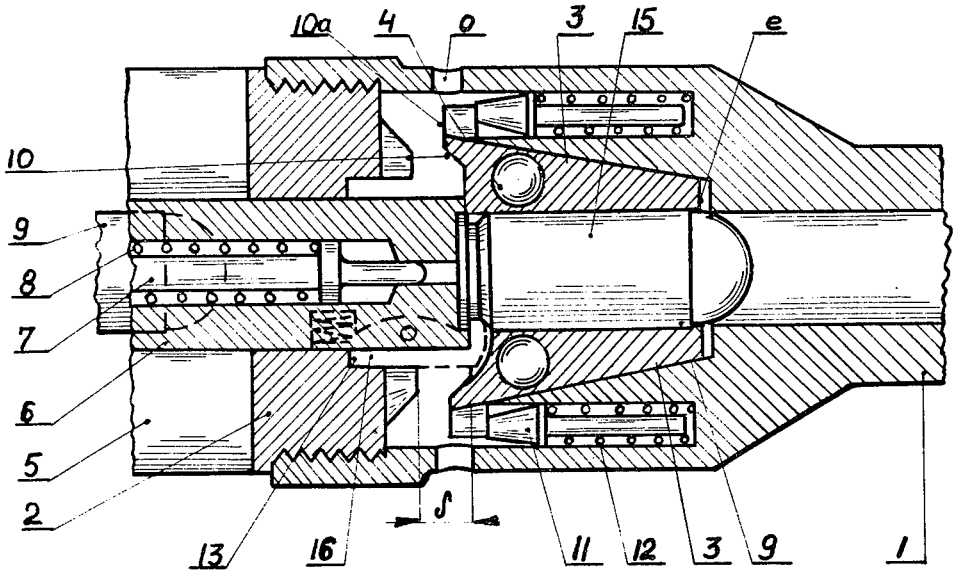
FIG. 1 shows coaxial section of the barrel-chamber of a gun having a cartridge-holder.
Figure 4:
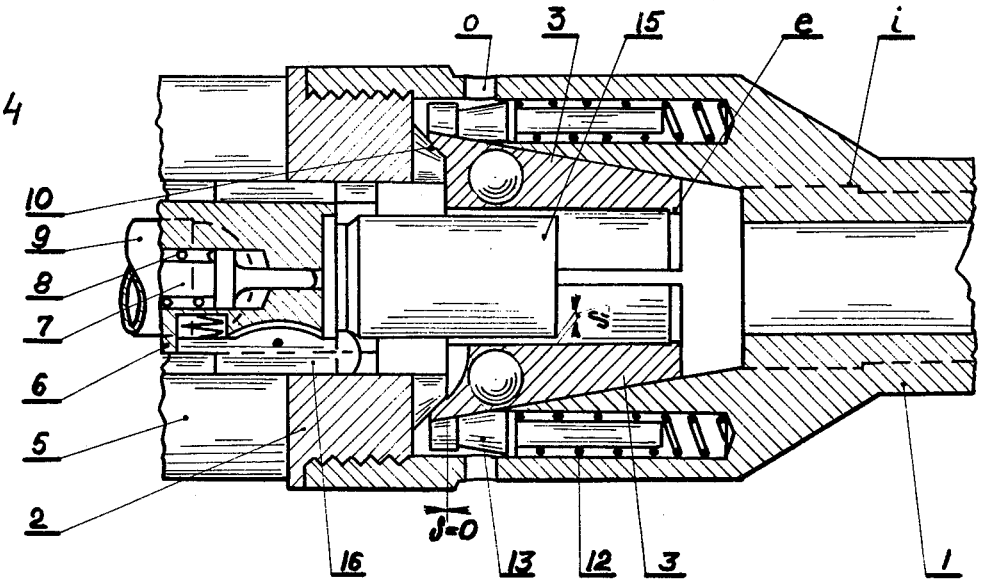
FIG. 4 shows the position of parts after discharge.

FIG. 1 shows interdependent arrangement of parts after the introduction of the cartridge 9 from the clip into the chamber just prior to the shooting. FIG. 4 shows the position of parts of the same gun after discharge and back-movement of the set 6+15+3 of size $\delta$ and the segments opened of size $\delta'$.

Suppose the bolt 6 of a breech-block rifle is in the extreme rear position and is pushed forward, It takes the cartridge 9 and moves it into the three part cartridge-holder 3 which is held by pins 11 and springs 12 in the left rear position and having the end edge "e". Under pressure of bolt 6 cartridge-holder 3 with cartridge 9 moves forward, sliding over the cone hole of the top of barrel 1 and the cartridge-holder 3 encircles the cartridge 9. The balls 4 cause the cartridge-holder segments to fall into the right end positions. Extractor 16 grasps the cartridge 9, lugs 13 close the cartridge. The discharge will follow when the firing-pin 7 with pushing spring 8 is released by the trigger. Pressure gasses push the bullet and press the sides and bottom of the case; thus pressing the segments of the cartridge-holder 3 on the cone hole of the barrel 1. The play of the cartridge 9 in the cartridge-holder 3 is somewhat smaller than in regular gun, and so the case remains jammed in it much tighter than the segments of cartridge-holder 3 in the cone hole of the barrel 1. By unlocking and opening of the bolt 6, the set: cartridge-holder 3 + case 15 pulled by extractor 16 moves back together with the bolt 6, and when the set travels the space $\delta$, the bumpers 10 strike against each other, and the segments of the cartridge-holder 3 expand about 0.015" and stop, releasing the case 15. The bolt 6 with case 15 move farther back. At the end position of the bolt 6—the case 15 is ejected through the opening 5 of the receiver 2 and the cycle repeats itself.

Figure 2:
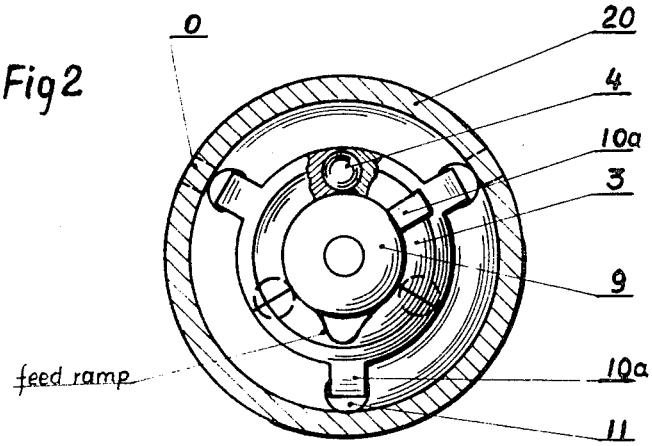
FIG. 2 is cross-section of the barrel with a cartridge-holder.

FIG. 2 shows the cross-section of the barrel 20 with cartridge-holder 3. The cartridge-holder 3 is divided in 3 segments, which have the balls 4, causes the cartridge-holder segments to fall in the right position. The drawing shows farther levels 10*a*, gasses escape holes 0 and cartridge 9.

Figure 3:
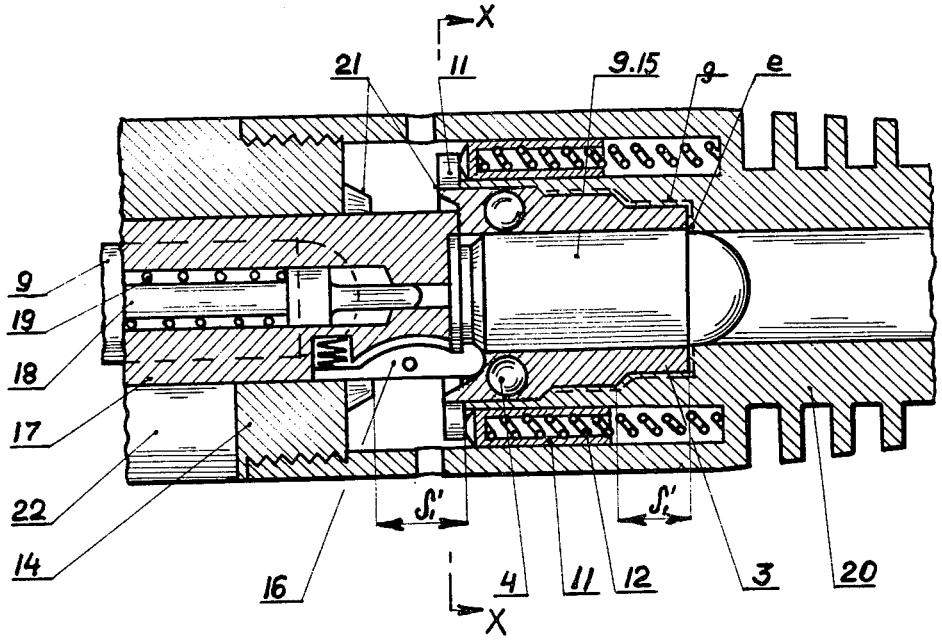
FIG. 3 shows the barrel-chamber of a gun with blow-back action bolt.

FIG. 3 shows a blow-back device gun having barrel 20, with edge e, receiver 14 and bolt 17. Suppose bolt 17 is in the extreme rear position (when it is open) and is pushed forward. It takes the cartridge 9 from clip and moves it into the three-part cartridge-holder 3 holding it by pins 11 and springs 12 in the left rear position and opening by the bumper 21. Under pressure of bolt 17 cartridge-holder 3 and cartridge 9 move forward sliding over the cylindrical hole of the barrel 20 and the segments of the cartridge-holder 3 encircles the cartridge 9. The balls 4 cause the catridge-holder 3 to fall in the right position. Extractor 16 grasps the cartridge 9. The discharge will follow when the firing pin 18 pushed by spring 19 is released by the trigger. Pressure gasses push the bullet and press the sides and the bottom of the case 15; thus pressing the segments of the cartridge-holder 3 on the hole of the barrel 20. The set: case 15+ cartridge-holder 3+ bolt 17 will start to move back. On the bolt 17 are pressing powers: first from gas pressure on the bottom of the case 15 and second from the gas pressure on the cartridge-holder 3. When the set travels the space about $\frac{1}{4}\partial_1{}^1$—the bullet has already left the muzzle—and then $\partial_1{}^1$, the bumpers 21 strike against each other and the segments of the cartridge-holder 3 expand about 0.015" and stop, releasing the case 15 which is held by extractor 16 and bolt 17 moves back. At the end position case 15 is ejected through opening 22 and the cycle repeats itself. The cartridge-holder 3 has three cylindrical tops—FIG. 3. The barrel has grooves "g" the length of two of these to facilitate the back movement.

Using for the cases hard aluminum—the yield strength is max 59,000 lbs. psi$^{-}$', elasticity modulus 10.10$^6$ lbs. psi$^{-}$(when it is cold worked). For brass these measurements are 62,000 lbs. psi$^{-1}$ and 15. 10$^6$ lbs. psi$^{-1}$. And so aluminum can almost be used instead of brass with the pressure to 50,000 lbs. psi$^{-1}$ even though it has a greater coefficient of friction, because when using cartridge-holder friction does not play a role. Cartridge-holders can be fashioned of titanium alloy, inconel, steel. Steel cases having yield strength 70–100,000 lbs. psi$^{-1}$ and reinforced caps to withstand the pressure will be used to powder pressures about 80–90,000 lbs. psi$^{-1}$. Cartridge-holders must be made from alloys steel diffusingly hardened with other metals (such as tungsten or titanium) or carbides. Similarly barrels and bolts need chemical working for safety from erosion—some countries have made such adjustements for a long time past—or can have inner anti-erosion insertions for quick change: as in FIG 4—"i".

Faults of the cartridge-holders:

(a) larger pressure on bolt (but it is sometime desirable), (b) larger escape of gasses to the rear, (c) progressive erosion growing with pressure, (d) limiting to special ammo only.

Gains are:

(a) independence from friction between the case and barrel, (b) possibility of raising the pressure of powder gasses to the maximum stregth of the barrel.

We claim:

1. A firearm for firing cartridges comprising a receiver having a breech end, a barrel attached to said receiver at said breech end, said barrel having a cone hole at the breech end thereof, a cartridge holder located in said cone hole, and a bolt movable in said receiver so as to contact said cartridge-holder wherein the improvement comprises:

(a) said cartridge-holder being formed of a plurality segments held by pins and springs in the cone hole at the breech end of the barrel, said springs biasing the cartridge-holder segments partially out of said cone hole, (b) balls in said cartridge-holder segments to cause the cartridge-holder segments to fall into the right end positions, and (c) bumpers on said receiver and said cartridge-holder segments which strike against each other causing said segments to expand, whereby said bolt moving forward in said receiver, takes a cartridge, moves it into the cartridge-holder, and contacts said cartridge-holder; under the pressure of contact by the bolt, the cartridge-holder, with the cartridge therein, moves into said cone hole against the bias of said springs, jamming said cartridge-holder segments tightly around the cartridge; upon firing the cartridge, the cartridge, the cartridge-holder, and said bolt move back until the bumpers strike against each other, expanding the segments of the cartridge-holder, causing release of the cartridge for extraction, and ejection.

* * * * *